United States Patent [19]

Calabrese

[11] 4,393,522

[45] Jul. 19, 1983

[54] ANKLE GARTER WITH FOOT STIRRUP

[76] Inventor: Diane M. Calabrese, 9710 Roosevelt Blvd., Philadelphia, Pa. 19115

[21] Appl. No.: 327,275

[22] Filed: Dec. 4, 1981

[51] Int. Cl.[3] ..... A41F 1/00; A41D 1/06

[52] U.S. Cl. ..... 2/336; 2/232; 36/2 R

[58] Field of Search ..... 2/232, 242, 335, 305; 36/2 R

[56] References Cited

U.S. PATENT DOCUMENTS

| | | | |
|---|---|---|---|
| 1,785,033 | 12/1930 | Lorenz et al. | 2/242 |
| 3,200,414 | 8/1965 | Sternberg | 2/232 |

FOREIGN PATENT DOCUMENTS

| | | | |
|---|---|---|---|
| 458986 | 8/1949 | Canada | 2/232 A |
| 204511 | 3/1939 | Switzerland | 2/232 A |
| 489841 | 8/1938 | United Kingdom | 2/232 A |

*Primary Examiner*—Doris L. Troutman
*Attorney, Agent, or Firm*—Max R. Millman

[57] ABSTRACT

An article to hold the bottom of trouser or pants legs in place to allow for ease of insertion in a sock, boot or the like. The article includes an open ended garter band including a longitudinally stretchable portion, a generally U-shaped longitudinally stretchable stirrup depending from the garter band and mating fuzz and hook members of the VELCRO fastener type on opposite faces of the free end portions of the garter band. The stirrup is looped around the arch of the foot and the garter band is wrapped around the pants leg above its bottom edge and adjacent the ankle where the free end portions are pressed together to close the ankle garter band whereby the fuzz and hook members engage. The garter can be opened by pulling the overlapped ends apart.

4 Claims, 4 Drawing Figures

ANKLE GARTER WITH FOOT STIRRUP

This invention relates to an ankle garter with a foot stirrup to narrow and hold the bottom of pants in place so that a sock or boot will fit over it with ease.

The primary object of the invention is to provide an ankle garter with foot stirrup which is attractive, inexpensive to fabricate and easy to hook over the arch portion of the foot and around the gathered pants at the ankle.

Another object of the invention is to provide an ankle garter with foot stirrup in which the stirrup is an elastic band and the ankle garter is an open band which is adjustable to fit around legs and pants of varying girth because it includes an elastic portion and free end portions which can be overlapped and closed by finger pressure and can be opened also by finger pressure, the same being accomplished by interengaging VELCRO-type fasteners at the overlapped end portions.

Another object of the invention is to provide an ankle garter and foot stirrup of the character described which require no modification of the pants legs and which can be fabricated of varying colors and textures to complement the colors and textures of the pants legs to which it is attached.

Applicant is aware of a number of patents disclosing trouser leg containment or hold-down devices. Such a device is shown in the Haberfeld U.S. Pat. No. 2,455,479 which includes a heel piece, a stirrup strap and a front instep flap, all affixed to the lower edge of the pants cuff so that the pants require alteration since the hold-down device is not a separate adjustable unit.

The Schultz U.S. Pat. No. 2,670,474 is designed to hold down a pajama trouser leg which is not adjustable as it uses a non-elastic loop to embrace the foot, a non-elastic ankle strap attached thereto at a particular location by snap fasteners and a vertically extending elastic strap with a buckle at its end to grasp the bottom of the trouser leg. This device does not act to gather the trouser leg and hold it so gathered for insertion in a sock or boot.

The Jaffee U.S. Pat. No. 3,733,615 discloses a cuff piece insertable inside stretch ski pants and attached thereto by Velcro-type fasteners. This insertable cuff cannot function as the instant article to gather pants legs of varying sizes and hold them so gathered in place so that a sock or boot can be easily pulled thereover. Aside from this, the Velcro fasteners used in this patent require alteration of the trouser leg as one unit, fuzz or hook, must be sewn to the outer portion of the trouser leg while the other cooperative Velcro unit is sewn to the inner portion of the cuff.

The Swiss Pat. No. 204,511 discloses a device to hold down a ski trouser leg over a shoe, not one to gather and hold the trouser leg so gathered so that it can be easily inserted in a sock or boot. While it employs an ankle band and shoe-engaging stirrup, the band is held around the pants leg by a buckle which is more difficult to manipulate than the present Velcro fasteners, which is necessarily bulkier and less attractive.

The objects of the invention are attained by providing an open ended ankle band and a substantially U-shaped arch enveloping stirrup in the form of a band depending therefrom, the portion of the ankle band between the attachment of the stirrup thereto being elastic. The stirrup band is attached to the ankle band at two locations inwardly of its free ends and one face of the ankle band between its free end and one attachment location of the stirrup has secured thereto one component, such as the fuzz, of a VELCRO fastener while the opposite face of the ankle band between its other free end and the other attachment location of the stirrup has secured thereto the complementary VELCRO component. Thus, when the stirrup is made to embrace the arch of the leg and the band is wrapped around the bottom of the pants at or above the ankle, the free end portions can be adjustably secured by overlapping them and pressing the complementary VELCRO components together with the fingers. Removal is easily effected by pulling the VELCRO components apart also with the fingers.

These and other objects and features of the invention will become more apparent as the following description proceeds in conjunction with the accompanying drawings wherein.

Specific reference will now be made to the drawings in which similar reference characters are used for corresponding elements throughout.

Figure 1:
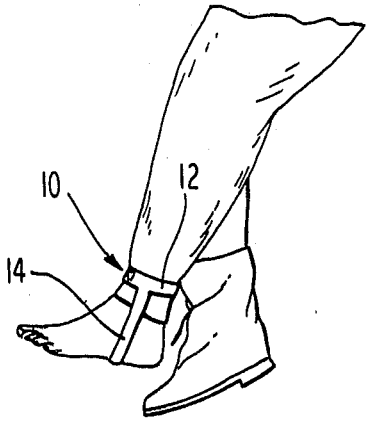
FIG. 1 is a perspective view showing the instant article in position over one trouser leg and foot, the other leg containing a boot receiving the leg.
Figure 4:
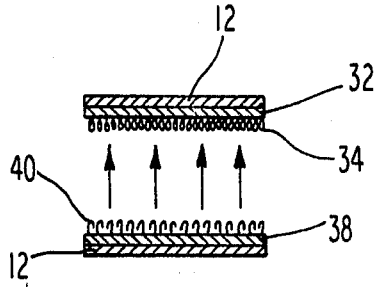
FIG. 4 is a sectional diagrammatic view illustrating the Velcro components.
Figure 2:
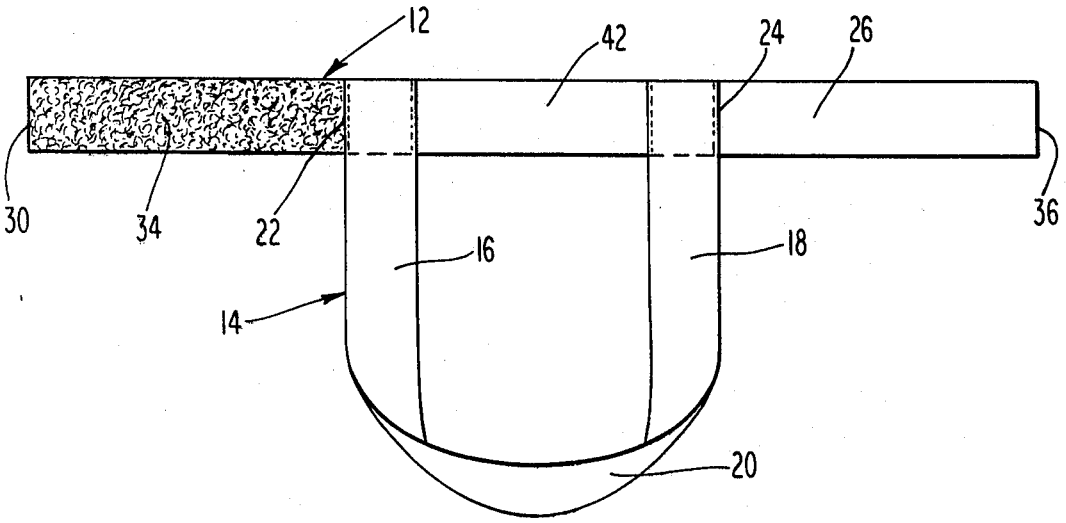
FIG. 2 is a rear or inside elevational view of the article in extended form.
Figure 3:
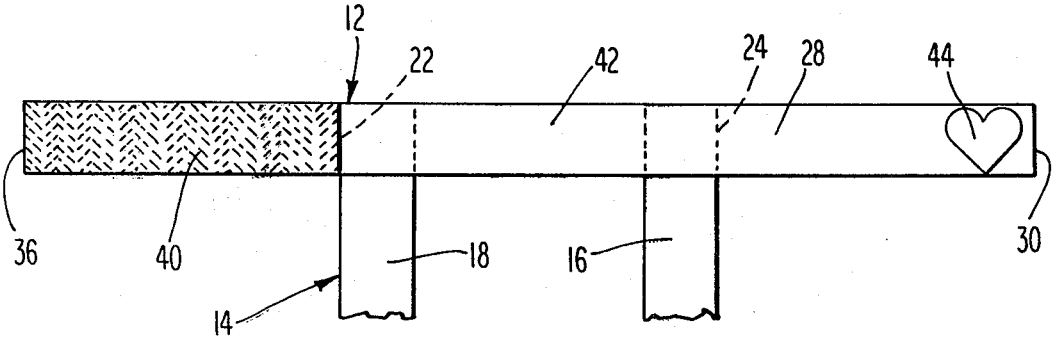
FIG. 3 is a view similar to FIG. 2, with parts of the stirrup broken away, showing the front or outside view of the article.

The manner of use is shown in FIG. 1; the ankle garter and foot stirrup per se is shown in FIGS. 2–4, to which reference is first made. The article generally indicated at 10 comprises an ankle garter 12, a depending stirrup 14 and a finger-pressure means to attach and detach the free end portions of the ankle garter.

The ankle garter includes an elongated band of any desired color, texture or size but preferably about 10" long in its extended open position and about ¾" wide. The stirrup is also in the form of a band and preferably of the same color, texture and width as the ankle garter band.

The stirrup is a generally U-shaped continuous elastic member, which may vary in size depending upon the foot size, and having leg portions 16 and 18 joined by a web portion 20. At predetermined locations as at 22 and 24, the upper free end portions of the stirrup legs are affixed to the ankle garter band 12 by appropriate means, such as sewing, adhesion or the like. The stirrup legs are preferably affixed to the garter ankle band 12 at the inner face 26 thereof although it is understood that the same can be affixed to the front or outer face 28 thereof.

Between one free end 30 of the garter ankle band 12 and the connection of the adjacent stirrup leg 16 to it as at 22, the band 12 has affixed to its inner face 26, as by sewing, adhesion or the like, a non-elastic tape or band 32 containing the fuzz portion 34, one component of commercially available VELCRO fasteners. While the fuzz component 34 may extend the entire length of that portion of the ankle garter band 12 which extends from its one free end 30 and the point of connection of the adjacent stirrup leg 16, for ease of fabrication, a shorter length of fuzz component 32, 34 can be used.

Between the other or opposite free end 36 of the ankle garter band 12 and the connection 24 of the other stirrup leg 18 to it, the outer face 28 of the ankle garter has affixed to it, as by sewing, adhesion or the like, a non-elastic tape or band 38 having thereon the hook portion 40 which is the component of VELCRO fastener that mates with the fuzz portion 34. Finger pressure between these components as illustrated in FIG. 4 causes the hooks of the hook component 40 to lockingly engage the fuzz of the mating fuzz component when they overlap and confront each other. The disengagement of these components is readily effected by pulling them apart, again merely by the use of the fingers. Here again, while the hook component 40 may extend the entire length of that portion of the ankle garter band 12 between its free end 36 and the connection point 22 of the stirrup leg 12 to the ankle garter band, for ease of fabrication, it can occupy a lesser length and should be as long as the fuzz mating component 34.

For ease of fabrication, the entire ankle garter band 12 may be elastic, but the affixing of the non-elastic fuzz and hook components 34 and 40 to the end portions of the ankle garter band 12 leaves a length 42 of said ankle garter band between the points of connection of the stirrup legs which remains elastic. It should be noted here that the reference to elasticity herein means that the stirrup and ankle garter are stretchable only lengthwise.

In use, the stirrup is made to embrace the arch portion of the foot and the ankle garter is wrapped around the pants leg above its bottom edge and closed by applying finger pressure to the overlapped ends of the ankle garter band whereby the fuzz component 34 at the end 30 engages the hook component 40 at the end 36 of the ankle garter band, as shown on FIG. 1. The stretchability of the portion 42 of the ankle garter band and stirrup allows the article to accommodate to different size feet and girth of pants legs and hold the article securely in place while a stocking or boot is pulled over the foot. To locate the edge 30 of the ankle garter band where pressure is applied to effect closure or a pulling action is applied to effect separation, an indicator 44 in the form of a suitable ornament is affixed to the outer face 28 adjacent the edge 30.

Thus, it will be seen that an inexpensive, easily fabricated, easily positioned ankle garter with stirrup is provided to hold the lower end of pants or trouser legs in place to permit ease of pulling a sock or boot over the foot. While a preferred embodiment has here been shown and described, variations may be made by skilled artisans without departing from the spirit of the invention.

What is claimed is:

1. An article to hold a pants leg in place on the foot for ease of insertion into a sock, boot or the like comprising an open ended garter band adapted to adjustably wrap around the bottom of the pants adjacent the ankle of the foot, a U-shaped longitudinally elastic stirrup having legs affixed to said garter band inwardly of the free ends of said garter band, the length of said garter band between the points on connection of said stirrup legs to said garter band being longitudinally elastic, and means at the opposite faces of said garter band adjacent its free ends mating by finger pressure to releasably close said garter band, said means including a fuzz portion on the inner face of said garter band adjacent one free end thereof and a mating hook portion on the outer face of said garter band adjacent its other end whereby when said ends are overlapped and pressed together said fuzz and hook portions will releasably interengage.

2. The article of claim 1 wherein said fuzz portion extends from said one free end of said garter band to the point of connection of the adjacent stirrup leg to said garter band and said hook portion extends from said other free end of said garter band to the point of connection of the other of said stirrup legs to said garter band.

3. The article of claim 2 wherein said stirrup legs are affixed to the inner face of said garter band.

4. The article of claim 1 and an ornamental indicator on the outer face of said garter band adjacent said one free end of said garter band for visual location of the area to be pressed for closure or pulled for opening of said garter band.

* * * * *